US011084635B2

(12) United States Patent
Faulkner

(10) Patent No.: US 11,084,635 B2
(45) Date of Patent: Aug. 10, 2021

(54) CHILD RESISTANT POP-TOP VIAL

(71) Applicant: F&S Tool, Inc., Erie, PA (US)

(72) Inventor: James D. Faulkner, Erie, PA (US)

(73) Assignee: F&S Tool, Inc., Erie, PA (US)

( * ) Notice: Subject to any disclaimer, the term of this patent is extended or adjusted under 35 U.S.C. 154(b) by 0 days.

(21) Appl. No.: 16/452,057

(22) Filed: Jun. 25, 2019

(65) Prior Publication Data

US 2020/0031539 A1 Jan. 30, 2020

Related U.S. Application Data

(60) Provisional application No. 62/702,753, filed on Jul. 24, 2018.

(51) Int. Cl.

| | |
|---|---|
| ***B65D 50/04*** | (2006.01) |
| ***A61J 1/03*** | (2006.01) |
| ***B65D 43/14*** | (2006.01) |
| ***B65D 83/04*** | (2006.01) |

(52) U.S. Cl.

CPC ..... *B65D 50/045* (2013.01); *A61J 1/03* (2013.01); *B65D 43/14* (2013.01); *B65D 83/04* (2013.01); *B65D 2215/02* (2013.01); *B65D 2215/04* (2013.01); *B65D 2251/1016* (2013.01)

(58) Field of Classification Search

CPC .... B65D 50/045; B65D 43/14; B65D 83/042; B65D 2215/02; B65D 2215/04; B65D 2215/1016; B65D 43/16; B65D 50/02; B65D 43/162; B65D 50/046; B65D 50/066; B65D 2543/00472; B65D 2543/00925; A61J 1/03

USPC ..... 215/216

See application file for complete search history.

(56) References Cited

U.S. PATENT DOCUMENTS 3,845,872 A * 11/1974 Towns ..... B65D 50/069 215/224

5,437,386 A * 8/1995 Von Holdt ..... B65D 43/0212 220/783

5,927,535 A 7/1999 Goth (Continued)

OTHER PUBLICATIONS

International Search Report received in related International Application No. PCT/US19/39227 dated Aug. 20, 2019.

(Continued)

*Primary Examiner* — J. Gregory Pickett
*Assistant Examiner* — Niki M Eloshway
(74) *Attorney, Agent, or Firm* — The Marbury Law Group, PLLC

(57) ABSTRACT

A vial comprises a vial top and a lid. The lid comprises a top and a bottom. A circular securing feature is attached to the bottom and has a diameter that is less than the diameter of the lid, thus forming a lip around the circumference of the bottom. The securing feature comprises a snap bead that extends outwards therefrom. An internal undercut in the vial mates with the snap bead when the lid is in the closed position. The vial top comprises a ledge. The underside of the lip secures to the ledge when the lid is in the closed position. An anti-pry wall is located on the ledge, having a diameter larger than the lid and surrounding the lid when the lid is in the closed position. The height of the anti-pry wall is taller than the underside of the lip when the lid is in the closed position.

5 Claims, 2 Drawing Sheets

(56) References Cited

U.S. PATENT DOCUMENTS

| | | | | |
|---|---|---|---|---|
| 6,772,902 | B1 * | 8/2004 | White | B65D 43/162 215/201 |
| 2006/0000833 | A1 | 1/2006 | Boots et al. | |
| 2006/0000866 | A1 * | 1/2006 | Yoshie | B27F 7/38 227/155 |
| 2009/0095699 | A1 * | 4/2009 | Milante | A61J 1/03 215/217 |
| 2009/0223967 | A1 * | 9/2009 | Mengeu | B65D 50/046 220/326 |
| 2012/0248129 | A1 * | 10/2012 | Yoshida | B65D 43/0212 220/780 |
| 2016/0130045 | A1 * | 5/2016 | Giraud | A61J 1/1425 53/492 |
| 2016/0130049 | A1 * | 5/2016 | Rogers | B65D 50/066 215/201 |
| 2017/0073130 | A1 * | 3/2017 | Giraud | B65D 43/162 |

OTHER PUBLICATIONS

Written Opinion of the International Searching Authority received in related International Application No. PCT/US19/39227 dated Sep. 13, 2019.

International Preliminary Report on Patentability and Written Opinion of the International Searching Authority received in related Application No. PCT/US2019/039227 dated Feb. 4, 2021.

* cited by examiner

CHILD RESISTANT POP-TOP VIAL

BACKGROUND

Pop-top vials are a category of pharmaceutical containers that are designed to be child resistant. The lid, attached with a living hinge, has an undercut feature that locks with the wall of the vial. Opening the lid or top requires squeezing the sides to relieve the undercut and "pop" the lid open. The reasoning behind this is that children do not typically have the hand strength to squeeze sides of the vial together to open the lid. However, a persistent child could still manage to pry the lid off with a fingernail or a tool inserted along the edge of the lid where it sits on the top of the vial.

SUMMARY

What is presented is a vial comprising a vial top and a lid. The lid comprises a top and a bottom. A circular securing feature is attached to the bottom. The diameter of the securing feature is less than the diameter of the lid, thus forming a lip around the circumference of the bottom. The securing feature further comprises a snap bead that extends outwards therefrom. The vial has an internal undercut that mates with the snap bead when the lid is in the closed position. The vial top comprises a ledge. The underside of the lip secures to the ledge when the lid is in the closed position. An anti-pry wall is located on the ledge. The anti-pry wall has a diameter larger than the lid and surrounds the lid when the lid is in the closed position. The height of the anti-pry wall is taller than the underside of the lip when the lid is in the closed position.

The lid may be secured to the vial with a living hinge. In some embodiments, the height of the anti-pry wall is at least as tall as the top of the lid when the lid is in the closed position, while in other embodiments, the height of the anti-pry wall is taller than the top of the lid when the lid is in the closed position. The vial may be made of any material, but it is preferred that the vial is plastic.

Those skilled in the art will realize that this invention is capable of embodiments that are different from those shown and that details of the apparatus and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
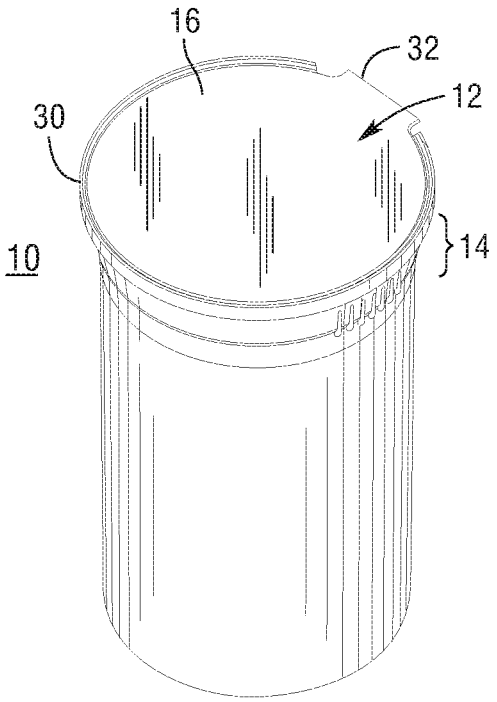
FIG. 1 shows a child resistant pop-top vial in the closed position.
Figure 2:
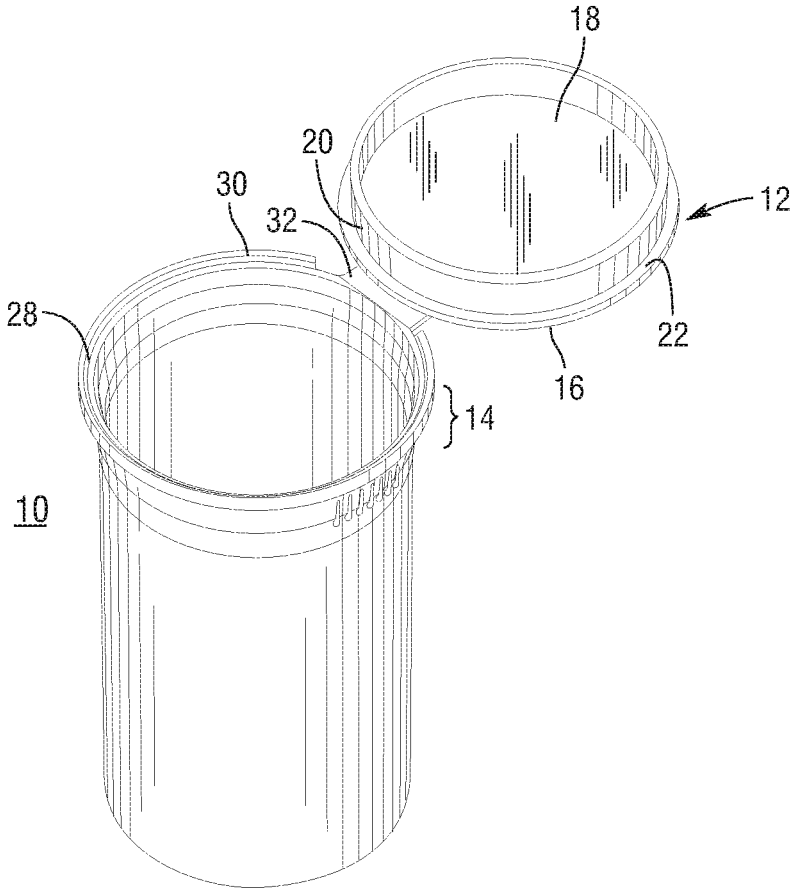
FIG. 2 shows the child resistant pop-top vial of FIG. 1 in the open position.

The pop-top vial presented herein addresses some of the limitations of prior art designs and make it more difficult for children to pry open the top of the vial. FIGS. 1 and 2 depict perspective views of an embodiment of the vial 10 with the lid 12 in the closed and the open position respectfully.

Figure 3:
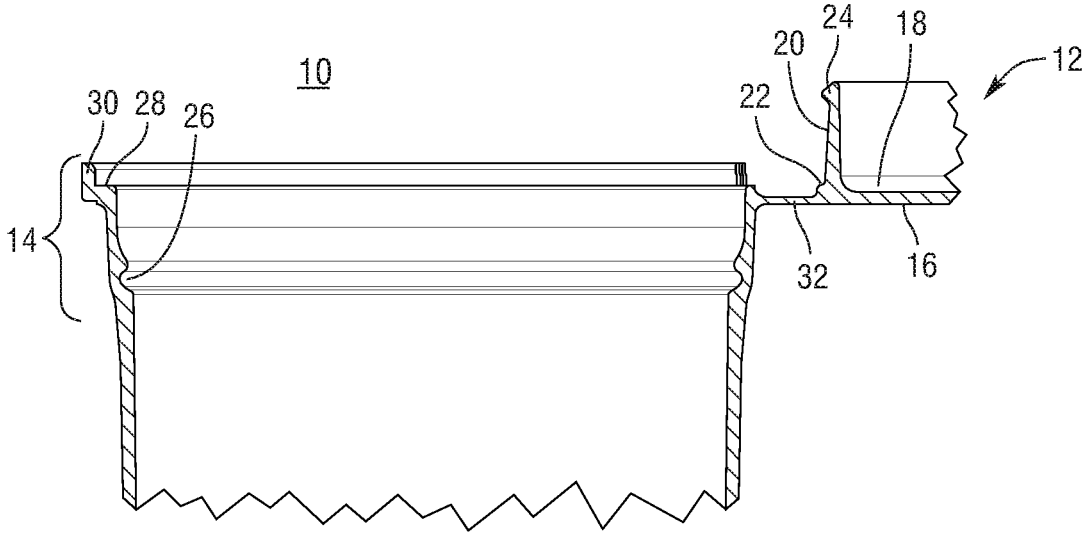
FIG. 3 is a cross sectional view of the upper portion of the child resistant pop-top vial of FIG. 1 in the open position.
Figure 4:
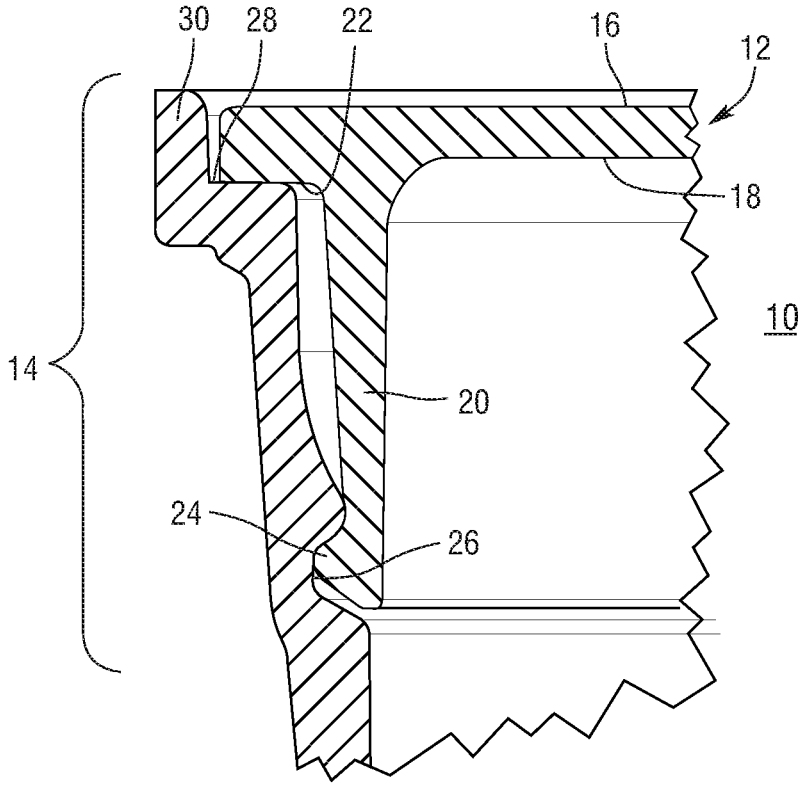
FIG. 4 is a close-up of a cross sectional view of the pop-top feature and the anti-pry feature of the pop-top vial of FIG. 1 in the closed position.

As best understood by looking at all of FIG. 1 through 4, but most closely seen in FIGS. 3 and 4, the vial 10 comprises a lid 12 and a vial top 14. The lid 12 comprises a top 16 and a bottom 18. A circular securing feature 20 is attached to the bottom 18. The diameter of the securing feature 20 is less than the diameter of the lid 12. This forms a lip 22 around the circumference of the bottom 18. The securing feature 20 comprises a snap bead 24 that extends outwards therefrom. An internal undercut 26 is located within the vial 10 that is configured to mate with the snap bead 24 when the lid 12 is in the closed position. The vial top 14 comprises a ledge 28. The underside of the lip 22 secures to the ledge 28 when the lid 12 is in the closed position. An anti-pry wall 30 is located on the ledge 28. The anti-pry wall 30 has a diameter larger than the lid 12 and surrounds the lid 12 when the lid 12 is in the closed position. The height of the anti-pry wall 30 is taller than the underside of the lip 22 when the lid 12 is in the closed position.

The vial 10 operates as other pop-top vials in the prior art: the user opens the lid by squeezing the sides of the vial 10 along the vial top 14 near the lid 12. This slightly deforms the vial top 14 and pushes the snap bead 24 out of the internal undercut 26 in the vial 10 causing the lid 12 to pop open. The anti-pry wall 30 keeps the lip 22 out of each reach of prying tools and more difficult to open without using the standard pop-top feature.

It is preferred that the lid 12 is secured to the vial with a living hinge 32. But this is not a requirement for the vial to operate. Vials 10 of these type are typically made of plastic but other materials that are pliable enough to operate as a pop-top feature may be used. The anti-pry wall 30 could be made of the same material or a different material.

It is understood that the height of the anti-pry wall 30 must be high enough to prevent access to the lip 22 of the lid 12 where it touches the ledge 28 when the lid 12 is in the closed position. The embodiment shown in the figures shows the height of the anti-pry wall 30 to be at least as tall as the top of the lid 12 when the lid 12 is in the closed position. In fact, the figures show that the height of the anti-pry wall 30 is taller than the top of the lid 12 when the lid 12 is in the closed position.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A vial comprising:

a lid having a top and a bottom;

a securing feature attached to said bottom surface of said lid, wherein said securing feature is circular, and a portion of the bottom of said lid extending radially outward from said securing feature defines a lip;

a snap bead extending outwards from the outer diameter of said securing feature;

a vial top including a ledge and an internal undercut, wherein said lip contacts said ledge when said lid is in the closed position, and said internal undercut is configured to mate with said snap bead when said lid is in the closed position; and an anti-pry wall on said ledge, wherein the inner diameter of said anti-pry wall is larger than the outer diameter of said lid, said anti-pry wall surrounds said ledge, the height of said anti-pry wall is taller than said lip when said lid is in the closed position, said lid is recessed with respect to the anti-pry wall when said lid is in the closed position and, with said anti-pry wall surrounding said ledge of the vial top, said lid is movable from the closed position to an open position.

2. The vial of claim 1, further comprising a living hinge securing said lid to said vial.

3. The vial of claim 1, wherein said vial is plastic.

4. The vial of claim 1, wherein the height of said anti-pry wall is at least as tall as said top of said lid when said lid is in the closed position.

5. The vial of claim 1, wherein the height of said anti-pry wall is taller than said top of said lid when said lid is in the closed position.

* * * * *